US010677188B2

(12) United States Patent
Koszewnik et al.

(10) Patent No.: US 10,677,188 B2
(45) Date of Patent: Jun. 9, 2020

(54) CYLINDER LINER FOR AN OPPOSED-PISTON ENGINE

(71) Applicant: ACHATES POWER, INC., San Diego, CA (US)

(72) Inventors: John J. Koszewnik, San Diego, CA (US); Bryant A. Wagner, Santee, CA (US)

(73) Assignee: Achates Power, Inc., San Diego, CA (US)

( * ) Notice: Subject to any disclaimer, the term of this patent is extended or adjusted under 35 U.S.C. 154(b) by 218 days.

(21) Appl. No.: 15/806,225

(22) Filed: Nov. 7, 2017

(65) Prior Publication Data

US 2018/0058368 A1 Mar. 1, 2018

Related U.S. Application Data

(62) Division of application No. 14/675,340, filed on Mar. 31, 2015, now Pat. No. 9,845,764.

(51) Int. Cl.
*F02B 77/00* (2006.01)
*F02F 1/00* (2006.01)
(Continued)

(52) U.S. Cl.
CPC ..... *F02F 1/004* (2013.01); *F02B 75/28* (2013.01); *F02B 75/282* (2013.01); *F02F 1/186* (2013.01); *F02F 2001/006* (2013.01)

(58) Field of Classification Search
CPC ..... F02F 1/004; F02F 1/186; F02F 11/005; F02F 2001/006; F02F 3/16; F02F 1/045;
(Continued)

(56) References Cited

U.S. PATENT DOCUMENTS 374,113 A 11/1887 Cayley et al. ..... 86/53
1,410,319 A 3/1922 Junkers ..... 123/41.78
(Continued)

FOREIGN PATENT DOCUMENTS

DE 3038235 A1 * 10/1980 ..... F02F 1/00
DE 3038235 A1 6/1982
(Continued)

OTHER PUBLICATIONS

Notification of Reasons of Refusal dated Sep. 24, 2019, for Japanese Patent Application No. 2017-550752.
(Continued)

*Primary Examiner* — George C Jin
*Assistant Examiner* — Teuta B Holbrook
(74) *Attorney, Agent, or Firm* — Terrance A. Meador; Julie J. Muyco

(57) ABSTRACT

A cylinder liner for an opposed-piston engine, and corresponding methods of extending engine durability and thermal management therewith, has opposite ends and a bore with a longitudinal axis for supporting reciprocating movement of a pair of opposed pistons. An intermediate portion of the liner extends between the opposite ends and includes an annular liner portion within which the pistons reach respective TC locations. A liner ring is seated in a portion of the bore in the annular liner portion, between the TC locations, for scraping carbon from top lands of the pistons and/or increasing the thermal resistance of the annular liner portion.

8 Claims, 7 Drawing Sheets

(51) Int. Cl.
*F02F 1/18* (2006.01)
*F02B 75/28* (2006.01)

(58) Field of Classification Search
CPC ..... F02F 1/08; F02F 3/10; F02B 75/28; F02B 25/08; F01B 7/02; F16C 33/08; F16J 10/04; F16J 10/02; F16J 1/08
See application file for complete search history.

(56) References Cited

U.S. PATENT DOCUMENTS

| | | | | |
|---|---|---|---|---|
| 1,955,292 | A * | 4/1934 | Heintz | F02F 1/08 29/888.061 |
| 2,367,419 | A * | 1/1945 | Morrell | B65D 15/06 493/109 |
| 2,423,395 | A * | 7/1947 | Lieberherr | F02F 1/186 123/41.79 |
| 2,246,841 | A | 8/1948 | Lieberherr | 123/193 |
| 2,446,841 | A * | 8/1948 | Lieberherr | F02F 1/186 123/41.79 |
| 2,624,328 | A | 1/1953 | Grinham et al. | 123/193.4 |
| 2,684,101 | A | 7/1954 | Clerke | |
| 2,703,077 | A | 3/1955 | Antonsen | 123/193 |
| 2,805,654 | A | 9/1957 | Jacklin | 123/51 BA |
| 2,835,308 | A * | 5/1958 | Stary | B21D 39/10 72/126 |
| 2,998,808 | A | 9/1961 | Jackson | 123/41.72 |
| 3,082,752 | A | 3/1963 | Thomas | 123/32 |
| 3,084,678 | A | 4/1963 | Lindsay | 123/51 B |
| 3,911,891 | A | 10/1975 | Dowell | 123/191 |
| 4,471,017 | A | 9/1984 | Poeschel et al. | 428/215 |
| 4,545,232 | A | 10/1985 | Martin et al. | 72/356 |
| 4,700,444 | A * | 10/1987 | Yamagata | B21D 28/28 123/193.2 |
| 4,711,208 | A | 12/1987 | Sander et al. | 123/271 |
| 4,911,109 | A * | 3/1990 | Kawamura | F01P 3/02 123/193.3 |
| 5,086,734 | A | 2/1992 | Nakai | 123/65 P |
| 5,236,787 | A | 8/1993 | Grassi | 428/552 |
| 5,320,909 | A | 6/1994 | Scharman et al. | 428/472 |
| 5,384,200 | A | 1/1995 | Giles et al. | 428/552 |
| 5,553,585 | A * | 9/1996 | Paro | F16J 10/04 123/193.2 |
| 5,582,144 | A | 12/1996 | Mizutani | 123/193.2 |
| 6,044,820 | A * | 4/2000 | Domanchuk | C23C 4/185 123/193.2 |
| 6,096,143 | A * | 8/2000 | Ruckert | B21J 5/004 148/439 |
| 6,136,106 | A * | 10/2000 | Commandeur | B22F 3/115 148/519 |
| 7,191,770 | B1 * | 3/2007 | Anderson | F02F 1/004 123/193.2 |
| 7,360,511 | B2 | 4/2008 | Lemke et al. | 123/41.35 |
| 7,428,889 | B2 | 9/2008 | Salzgeber et al. | 123/193.6 |
| 7,438,038 | B2 | 10/2008 | Azevedo et al. | 123/193.2 |
| 8,413,632 | B2 | 4/2013 | Sand | 123/193.2 |
| 8,485,147 | B2 | 7/2013 | Liu et al. | 123/51 B |
| 8,539,918 | B2 | 9/2013 | Lemke et al. | 123/52.2 |
| 8,851,029 | B2 | 10/2014 | Callahan et al. | 123/46 R |
| 8,935,998 | B1 | 1/2015 | Tebbe | 123/51 BD |
| 9,121,365 | B1 * | 9/2015 | Wagner | F02F 1/186 |
| 9,482,153 | B2 | 11/2016 | Bethel et al. | 123/193.1 |
| 10,060,529 | B2 * | 8/2018 | Cavanaugh | F16J 10/04 |
| 2005/0279296 | A1 | 12/2005 | Coney et al. | 123/41.84 |
| 2006/0124084 | A1 | 6/2006 | Hofbauer et al. | 123/55.7 |
| 2006/0150940 | A1 | 7/2006 | Kurt et al. | 123/193.4 |
| 2007/0000468 | A1 | 1/2007 | Azevedo et al. | 123/193.4 |
| 2008/0150237 | A1 | 7/2008 | Bischofberger et al. | 277/310 |
| 2008/0210204 | A1 | 9/2008 | Salzgeber et al. | 123/51 R |
| 2009/0241770 | A1 | 10/2009 | Blythe et al. | 92/260 |
| 2010/0326619 | A1 * | 12/2010 | Kim | B21J 5/00 164/460 |
| 2012/0186561 | A1 | 7/2012 | Bethel et al. | 123/51 R |
| 2013/0025548 | A1 | 1/2013 | Liu et al. | 123/41.17 |
| 2013/0199503 | A1 * | 8/2013 | Callahan | F16J 10/04 123/51 R |
| 2016/0032861 | A1 | 2/2016 | Fuqua | 123/51 R |
| 2016/0069293 | A1 | 3/2016 | McClearen et al. | 123/51 B |
| 2016/0097340 | A1 * | 4/2016 | Morgan | F02F 1/004 123/193.2 |
| 2016/0252043 | A1 | 9/2016 | McClearen et al. | F02F 1/004 |

FOREIGN PATENT DOCUMENTS

| | | | |
|---|---|---|---|
| DE | 10 2006 060330 | A1 | 6/2008 |
| EP | 0589598 | A1 | 3/1994 |
| EP | 0684411 | A1 | 11/1995 |
| GB | 851353 | A | 10/1960 |
| JP | S61-066845 | | 4/1986 |
| JP | 62-038459 | U1 | 3/1987 |
| JP | 03-021546 | U1 | 3/1991 |
| JP | H11-509288 | | 8/1999 |
| JP | 2007-030690 | | 2/2007 |
| JP | 2007-032401 | | 2/2007 |
| WO | WO-2005/003527 | A2 | 1/2005 |
| WO | WO-2005/003532 | A1 | 1/2005 |
| WO | WO-2009/147845 | | 12/2009 |
| WO | WO-2013/158107 | A1 | 10/2013 |
| WO | WO-2015/038425 | A1 | 3/2015 |

OTHER PUBLICATIONS

International Search Report for PCT application PCT/US2017/018978, dated May 11, 2017.
International Search Report for PCT application PCT/US2016/022599, dated May 27, 2016.
Third-Party Submission Under 37 CFR 1.290 in U.S. Appl. No. 14/828,689, filed Feb. 3, 2017.
Third-Party Submission Under 37 CFR 1.290 in U.S. Appl. No. 15/050,707, filed Mar. 17, 2017.
H. Indig and A. C. Haman, *Experimental Analysis of an Inwardly-Opposing Engine*, SAE Publication 850362, 1985.
Notice of Allowance dated Oct. 17, 2018 for U.S. Appl. No. 15/060,933.
Examination Report dated Feb. 14, 2019, issued by the European Patent Office for patent application No. 16714647.1.
Notification of First Office Action, dated Jun. 20, 2019, for Chinese patent application No. 2016800159829.

* cited by examiner

CYLINDER LINER FOR AN OPPOSED-PISTON ENGINE

RELATED APPLICATIONS/PRIORITY

This is a divisional application of U.S. application Ser. No. 14/675,340, which was filed on Mar. 31, 2015. This disclosure includes material related to the disclosure of commonly-owned U.S. application Ser. No. 13/385,127, filed Feb. 2, 2012, and titled "Opposed-Piston Cylinder Bore Constructions With Solid Lubrication In The Top Ring Reversal Zones", which is now U.S. Pat. No. 8,851,029 B2.

FIELD

The field includes opposed-piston engines. More particularly, the field relates to a cylinder liner constructed to support sliding movement of a pair of opposed pistons.

BACKGROUND

Construction of an opposed-piston engine cylinder is well understood. The cylinder is constituted of a liner (sometimes called a "sleeve") retained in a cylinder tunnel formed in a cylinder block. The liner of an opposed-piston engine has an annular intake portion including a cylinder intake port near a first liner end that is longitudinally separated from an annular exhaust portion including a cylinder exhaust port near a second liner end. An intermediate portion of the liner between the intake and exhaust portions includes one or more fuel injection ports. Two opposed, counter-moving pistons are disposed in the bore of a liner with their end surfaces facing each other. At the beginning of a power stroke, the opposed pistons reach respective top center (TC) locations in the intermediate portion of the liner where they are in closest mutual proximity to one another in the cylinder. During a power stroke, the pistons move away from each other until they approach respective bottom center (BC) locations in the end portions of the liner at which they are furthest apart from each other. In a compression stroke, the pistons reverse direction and move from BC toward TC.

A circumferential clearance space between pistons and cylinder liners is provided to allow for thermal expansion. After long hours of operation carbon builds up in this clearance space, on the top land of a piston. Carbon built up on the top land of a piston moving in this space can result in increased friction and ring wear; at worst it can cause ring jacking. In conventional four-stroke, single-piston engines, carbon removal from the top land is typically performed by scraper ring hardware mounted between the top of the cylinder liner and the cylinder head. In an opposed-piston engine, the possible sites for removing carbon are limited. An opposed-piston engine does not include a cylinder head where carbon scraper devices can be located. Liner construction further reduces the possibilities. It is preferable that carbon removal not occur near the BC locations of the pistons, where the ports are located. Carbon debris near the intake port can contaminate charge air entering the bore, thereby degrading combustion. Carbon debris in the vicinity of the exhaust port can be swept into the gas stream exiting the cylinder after combustion, thereby increasing exhaust emissions. It is therefore desirable to remove carbon from the piston top lands within the liner at locations distant from the intake and exhaust ports.

Another factor that degrades engine performance throughout the operating cycle of an opposed-piston engine is related to loss of heat through the cylinder liner. Combustion occurs as fuel is injected into air compressed between the piston end surfaces when the pistons are in close mutual proximity. Loss of the heat of combustion through the liner reduces the amount of energy available to drive the pistons apart in the power stroke. By limiting this heat loss, fuel efficiency would be improved, heat rejection to coolant would be reduced, which can allow use of smaller cooling systems, and higher exhaust temperatures can be realized, which leads to lower pumping losses. It is therefore desirable to retain as much of the heat of combustion as possible within the cylinder.

An opposed-piston engine cylinder liner constructed according to the present disclosure satisfies the objective of carbon removal, thereby increasing the durability of the engine relative to opposed-pistons of the prior art. An opposed-piston liner construction according to the present disclosure satisfies the objective of heat containment, thereby allowing opposed-piston engines to operate with higher heat retention than opposed-piston engines of the prior art. In some aspects, an opposed-piston liner construction according to the present disclosure satisfies both of these objectives simultaneously.

SUMMARY

A cylinder liner for an opposed-piston engine constructed in accordance with the present disclosure increases durability of an opposed-piston engine by reducing or eliminating carbon build-up on the top lands of opposed pistons contained in the liner. The cylinder liner has a cylindrical wall with an interior surface defining a bore centered on a longitudinal axis of the liner. The bore has a first diameter. Intake and exhaust ports are formed in the cylindrical wall near respective opposite ends of the liner. An intermediate portion of the liner extends between the ends and includes an annular liner portion within which the pistons reach their TC locations. The annular liner portion is defined between first and second top ring reversal planes that orthogonally intersect the longitudinal axis. The first top ring reversal plane is at a first axial position where the topmost ring of a first piston is located when the piston is at its TC location. The second top ring reversal plane is at a second axial position where the topmost ring of a second piston is located when the piston is at its TC location. A liner ring is seated in a portion of the bore contained in the annular liner portion. The liner ring has an interior annular surface with a second diameter that is slightly less than the first diameter. Thus, the liner ring slightly reduces the clearance space between the liner bore and top lands of the pistons. Since the liner ring includes the TC locations of the cylinder bore, the top land of each piston will only traverse the liner ring when the piston approaches and leaves TC. Therefore, the liner ring reduces the clearance where carbon collects so as to remove excess carbon as the top lands pass over the ring.

The highest concentration of heat in the cylinder occurs in the annular portion of the liner between the TC locations of the pistons, where combustion takes place. Nearly half of the total heat flux into the liner occurs in this annular portion. Accordingly, construction of the liner ring in such a manner as to yield a high thermal resistance will reduce heat flux through the annular liner portion.

DETAILED DESCRIPTION

Figure 1:
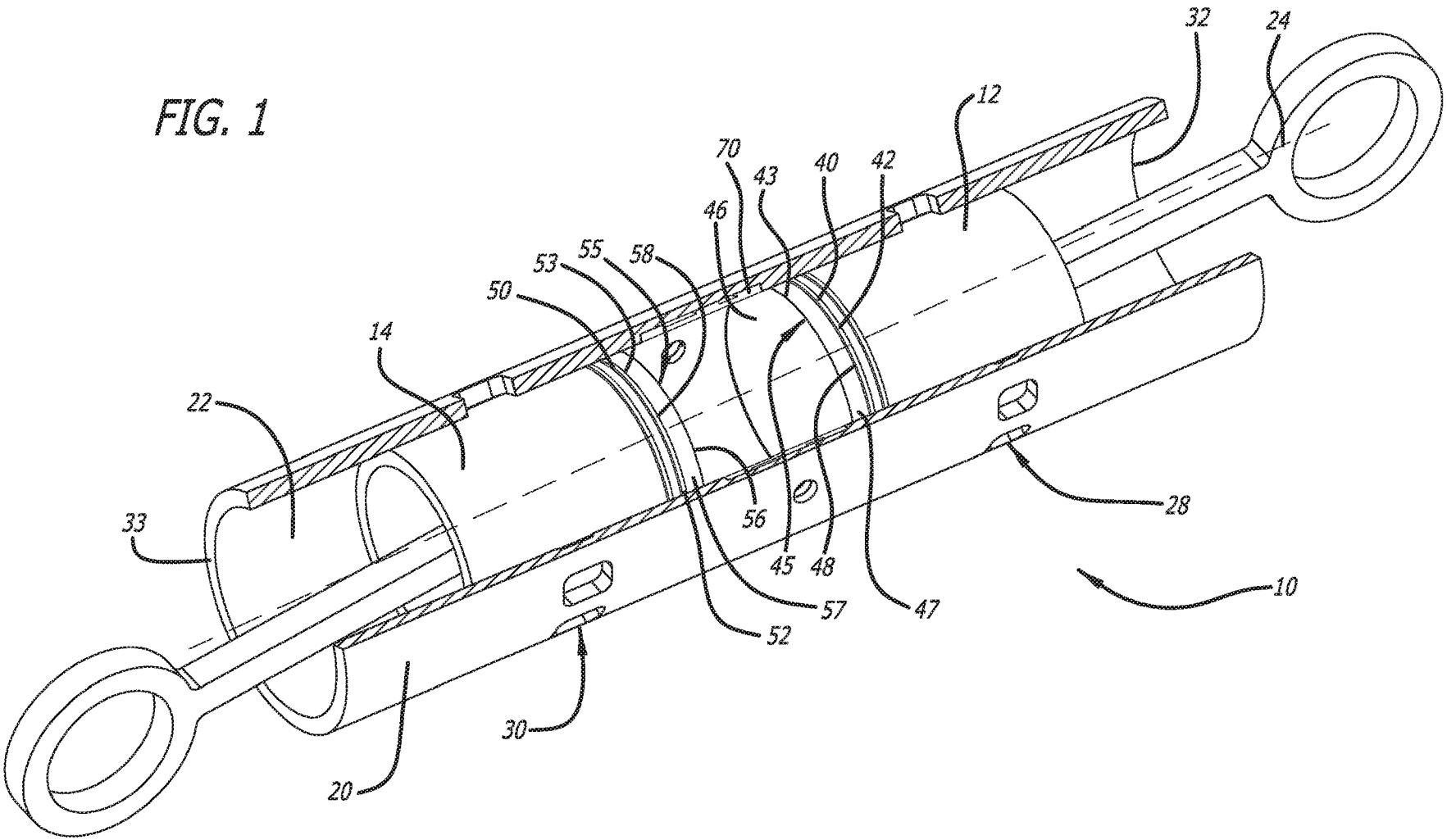
FIG. 1 is a perspective view of a cylinder in accordance with the present disclosure with a section removed to show a pair of opposed pistons disposed in a bore therein between bottom and top center positions.
Figure 2:
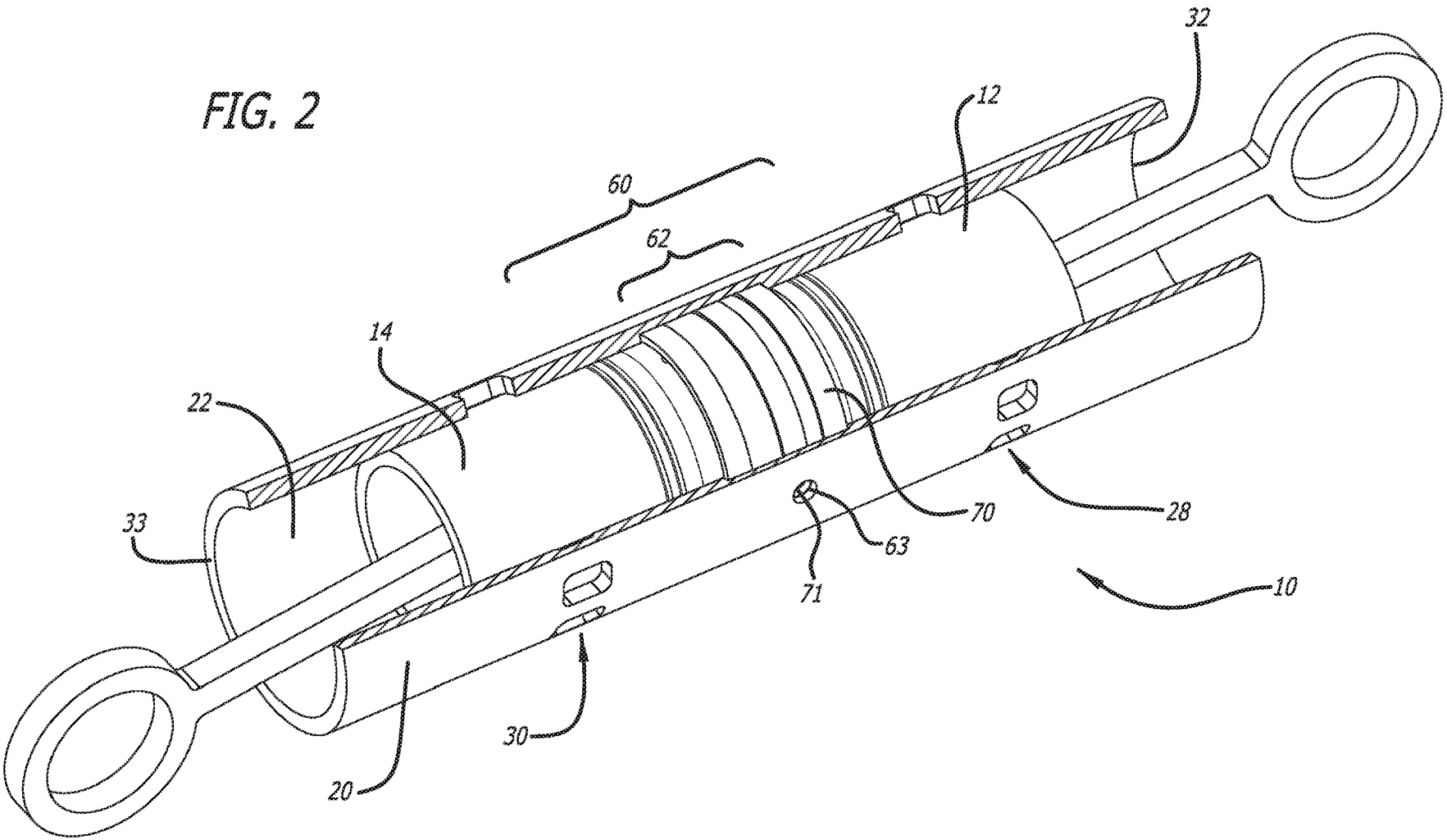
FIG. 2 is a perspective view of the cylinder of FIG. 1 with a section removed to show a liner ring seated in the bore of the cylinder of FIG. 1.
Figure 3:
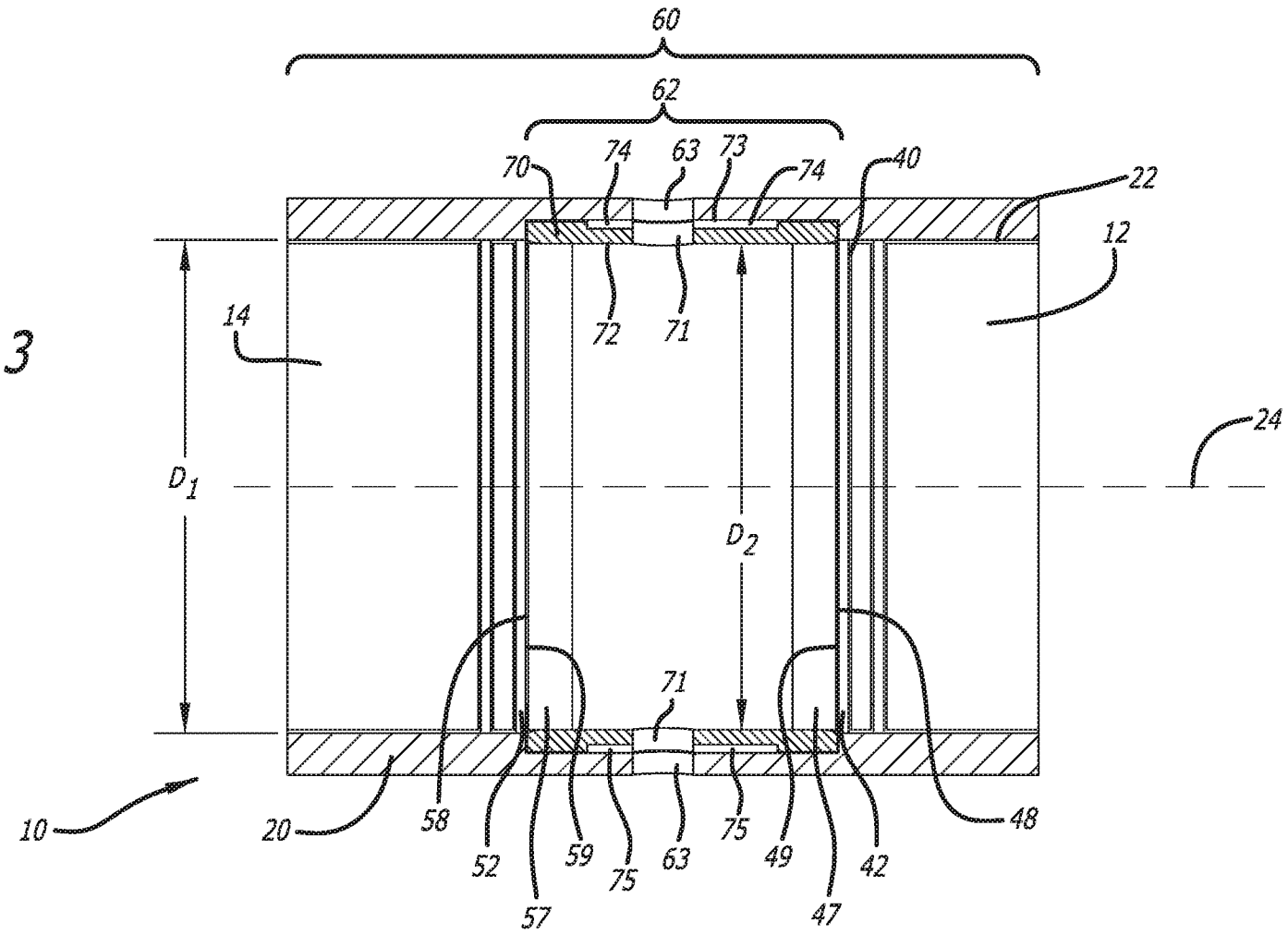
FIG. 3 is an enlarged side sectional view of an annular liner portion of the cylinder liner of FIGS. 1 and 2 showing the liner ring in greater detail.

With reference to the drawings, FIGS. 1, 2, and 3 show a cylinder liner 10 constructed in accordance with the present disclosure with a section removed to show a pair of opposed pistons 12, 14 therein between bottom and top center positions. Although not shown, the cylinder liner with the pistons therein would be retained in a cylinder tunnel of an opposed-piston engine, for example in the manner described and illustrated in commonly-owned U.S. Ser. No. 14/450,572, filed Aug. 4, 2014 for "Opposed-Piston Engine Structure With A Split Cylinder Block." The cylinder liner 10 has a cylindrical wall 20 with an interior surface defining a bore 22 centered on an imaginary longitudinal axis of the liner (represented by the line 24). The bore 22 has a first diameter $D_1$. Longitudinally-spaced intake and exhaust ports 28 and 30 are formed or machined near respective ends 32 and 33 of the cylindrical wall 20. Each of the intake and exhaust ports 28 and 30 includes one or more circumferential arrays of openings or perforations. In some other descriptions, each opening is referred to as a "port"; however, the construction of one or more circumferential arrays of such "ports" is no different than the port constructions shown in FIGS. 1 and 2.

As is typical, the piston 12 includes at least one annular ring groove 40 with a piston ring 42 retained therein. The piston 12 has a circular peripheral edge 43 where the piston crown 45 meets the end surface 46 of the piston. An annular uppermost top land 47 of the piston extends between an upper surface 48 of the ring groove 40 and the peripheral edge 43. An imaginary annular top ring reversal plane (represented by the circular line 49) that extends around the bore 22 and generally orthogonally to the longitudinal axis 24 indicates an axial location (with respect to the axis 24) where the upper surface 48 of the top ring groove 40 instantaneously comes to rest when the piston 12 reverses direction and begins to move away from TC. Similarly, the piston 14 includes at least one annular ring groove 50 with a piston ring 52 retained therein. The piston 14 has a circular peripheral edge 53 where the piston crown 55 meets the end surface 56 of the piston. An annular uppermost top land 57 of the piston extends between an upper surface 58 of the ring groove 50 and the peripheral edge 53. An imaginary annular top ring reversal plane (represented by the circular line 59) that extends around the bore 22 and generally orthogonally to the longitudinal axis 24 indicates an axial location (with respect to the axis 24) where the upper surface 58 of the top ring groove 50 instantaneously comes to rest when the piston 14 reverses direction and begins to move away from TC.

Figure 4:
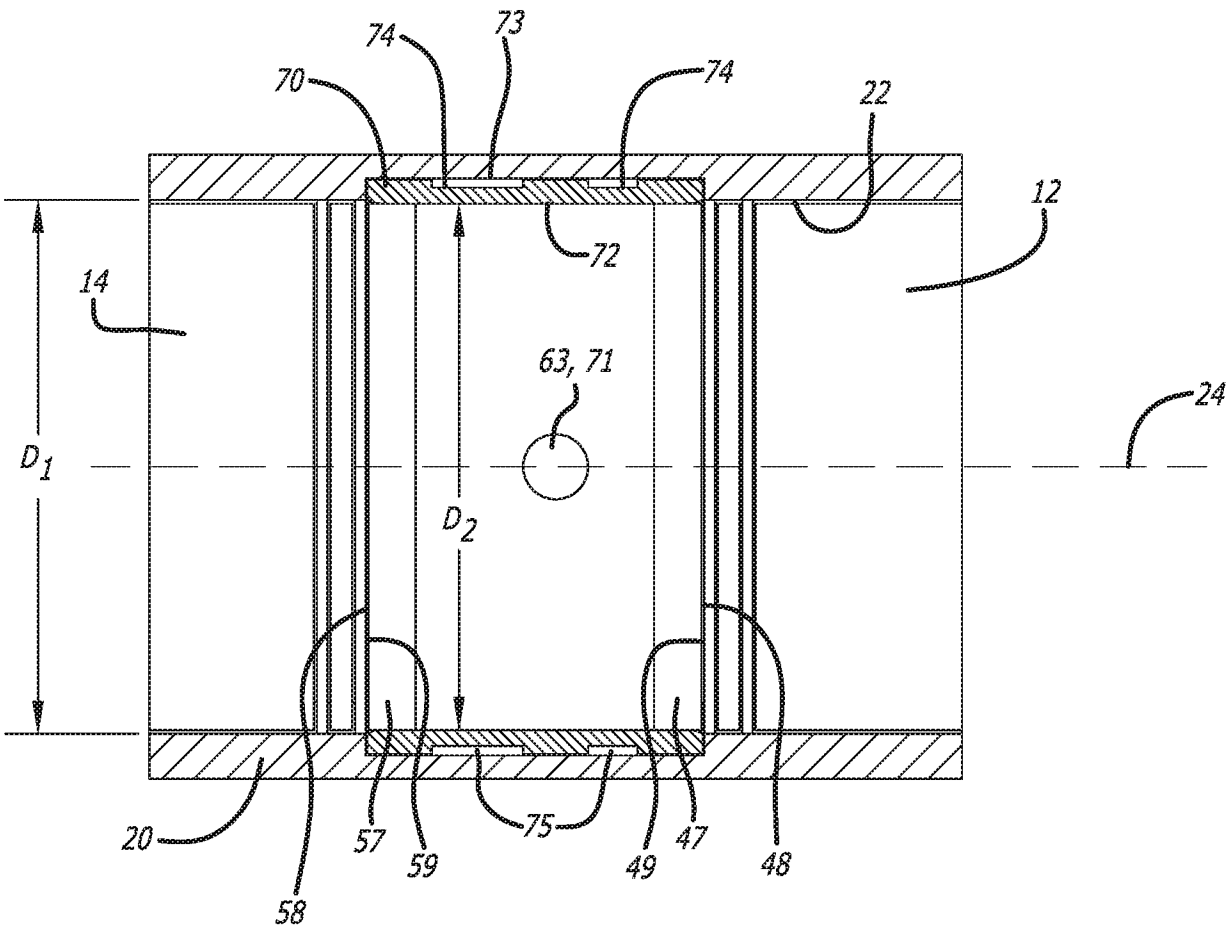
FIG. 4 is the view of FIG. 3 rotated axially by 90°.

An intermediate portion 60 of the liner extends between the ends 32 and 33 and includes an annular liner portion 62 of the cylinder wall 20 within which the pistons 12 and 14 reach their TC locations The annular liner portion 62 is defined between the first and second top ring reversal planes 49 and 59. As per FIGS. 2, 3, and 4, at least one fuel injector port 63 is provided through the annular liner portion 62 in which a fuel injector nozzle (not shown) is seated when the engine is assembled. In the example shown in these figures two fuel injector ports 63 are provided at diametrically-opposed locations in the annular liner portion 62. A liner ring 70 is seated in a portion of the bore contained in the annular liner portion 62. The liner ring 70 has an interior annular surface 72 with a second diameter $D_2$ that is slightly less than the diameter $D_1$ of the bore 22. Thus, the liner ring 70 slightly reduces the clearance between the liner bore 22 and top lands 49, 59 of the pistons 12, 14. Since the liner ring 70 extends between the top ring reversal planes, the top land of each piston will only traverse the liner ring when the piston approaches and leaves TC. Therefore, the liner ring reduces the clearance where carbon collects so as to remove excess carbon as the top lands 49, 59 pass over the liner ring 70. As can be seen in FIGS. 3 and 4, the liner ring 70 also includes one or more ports 71 for passage of fuel into the bore. The ports 71 are aligned with the fuel injector ports 63 in the annular liner portion 62. In a preferred construction for seating the liner ring 70 in the bore 22, the liner 10 includes an annular groove 73 in the portion of the bore 22 contained in the annular liner portion 62. The liner ring 70 is received and retained in the annular groove 73.

The annular liner portion 62 defines space inside the bore where combustion occurs. In order to enhance the thermal resistance of this portion of the liner 10, the liner ring 70 can be made to reduce heat flux through the annular liner portion 62 by elevating its thermal resistance with respect to that of the liner itself. In this regard, the material of which the liner ring 70 is made may be selected for a higher thermal resistance than the material with which the liner is made. Alternatively, as shown in FIGS. 2 and 3, the liner ring 70 may be provided with one or more grooves 74 on its outer annular surface with which to form one or more annular air-filled chambers ("air resistors") 75 with the bore 22. Of course, both thermal management options may be used in constructing the liner ring 70. As a result thermal management is enabled during combustion of a mixture of fuel and air between the end surfaces of a pair of pistons disposed in the cylinder liner when the pistons are near respective top center locations in the annular liner portion of the cylinder liner by impeding flow of heat through the cylinder liner with a higher resistance in the annular liner portion than in the rest of the cylinder liner.

This cylinder liner construction can provide an added structural element where maximum compression and peak cylinder pressures occur and so may eliminate the need for an additional external liner sleeve to provide this support. Furthermore, scraping carbon off of the piston top lands will reduce the occurrences of ring jacking, and thereby improve the durability of an opposed-piston engine. Finally, the liner ring can reduce the heat flow through the cylinder liner, between the top ring reversal locations, where nearly half of the total heat lost into the liner occurs.

The body of the cylinder liner may be made from cast iron, or other suitable material. The liner ring 70 may be made from steel, titanium, or other suitable material such as Inconel, to ensure structural integrity of the cylinder liner in the area of maximum pressures during combustion.

The liner illustrated in FIGS. 1-3 may be assembled by attaching the liner ring 70 to the liner 10 either with a mechanical fastener or with an interference fit. For an interference fit, the following steps illustrate a preferred method of constructing a cylinder liner according to this disclosure:

1. The liner is constructed with intake and exhaust ports and the bore 22 is initially honed.
2. The annular groove 73 is formed by machining or etching the bore portion of the annular liner portion 62.
3. The bore 22 is honed after the annular groove 73 is formed.
4. The liner is heated to increase inside diameter $D_1$ and the liner ring 70 is heated to increase its formability.
5. The liner ring 70 is placed in the center of the cylinder liner over the annular groove 66.
6. The liner ring 70 is swaged into the annular groove 73 by driving tapered mandrels through the center of the liner ring 70 so as to expand the liner ring 70 into the annular groove 66.
7. The liner 10 and the ring 70 are cooled.
8. From either end of the liner 10, punches with the approximate shape of the piston top land profile are driven to the liner ring 70. This will accomplish three goals:
   a. It will complete the swaging process,
   b. It will fully embed the liner ring 70 into the annular groove 66.
   c. It will properly size the inner diameter of the liner ring 70.
9. Form one or more injector ports through the annular liner portion 62 and the liner ring 70.

Alternatively, if the liner ring 70 is formed of a ceramic material, it would be made so that the outer ends of the insert were slightly higher than the body of the insert so that a scraping interference will occur between the insert ends and the piston lands.

Figure 5:
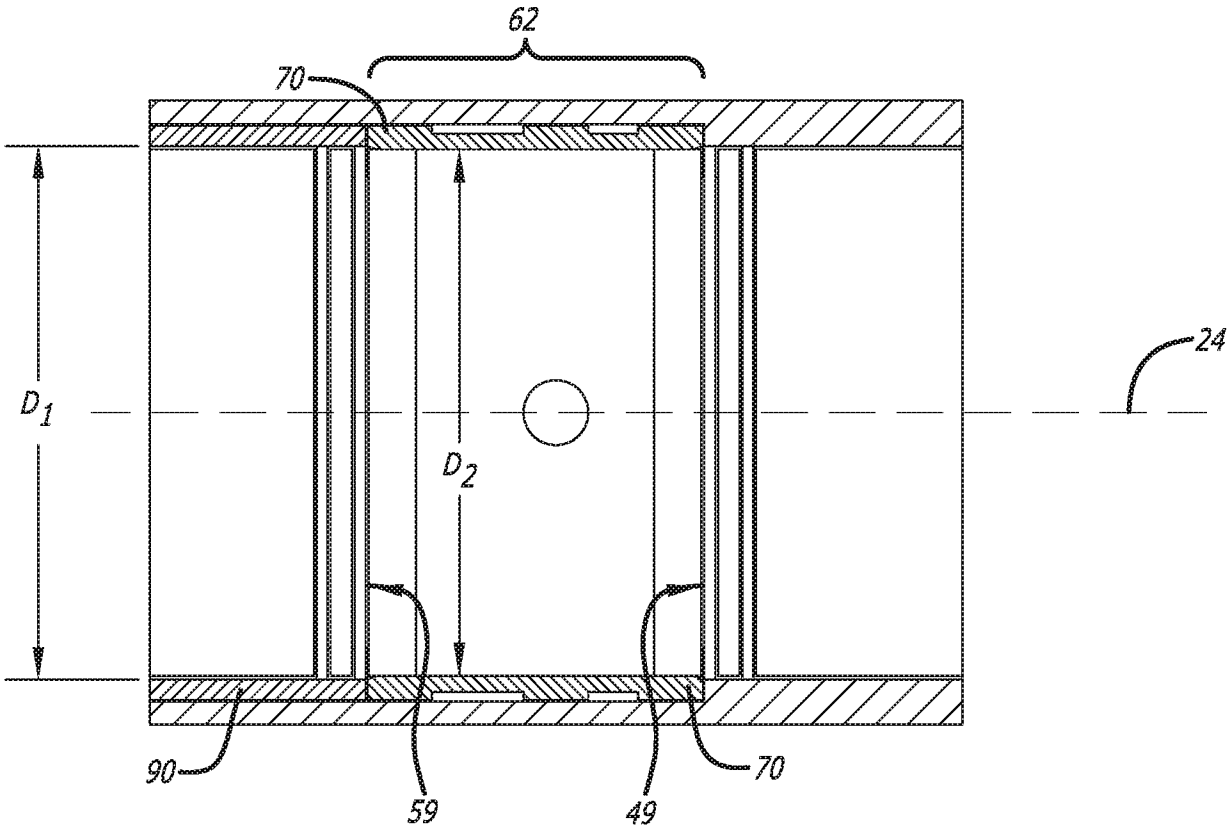
FIG. 5 is an enlarged side sectional view of a first alternate cylinder liner construction in accordance with the present disclosure.

A first alternate cylinder liner construction according to this disclosure is shown in FIG. 5. In this construction the liner bore diameter is enlarged slightly by machining from one end of the liner into the annular liner portion 62. This allows the liner ring 70 to be installed directly from the one end of the cylinder without the need to fabricate it with a slightly smaller outer diameter than the bore and then be enlarged by a mandrel to fit into the groove in the annular liner portion. Once the liner ring 70 is secured in the interior of the liner annular liner portion 62, an inner liner sleeve 90 having an interior diameter equal to that of the rest of the cylinder is then installed up to the liner ring 70 and is secured therein. The liner ring could be attached to the cylinder liner with mechanical fasteners or seated therein by means of an interference fit. An interference fit could be accomplished by either super cooling the sleeve, (using liquid Nitrogen as an example), to shrink its outside diameter before placing it in the enlarged bore portion and then letting it reach room temperature. Alternatively, the liner could be heated to increase its inside diameter before inserting the sleeve and then both the liner and the inserted sleeve would be cooled.

Figure 6:
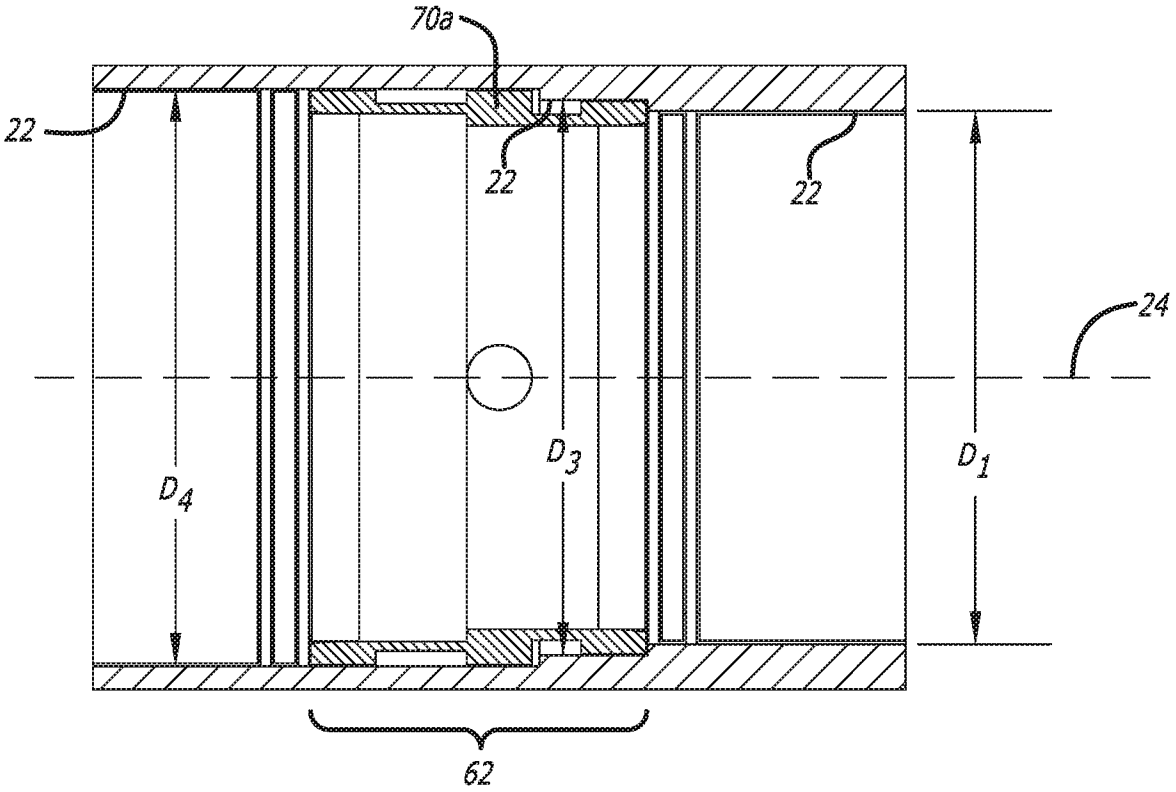
FIG. 6 is an enlarged side sectional view of a second alternate cylinder liner construction in accordance with the present disclosure.

A second alternate cylinder liner construction according to this disclosure is shown in FIG. 6. In this construction the liner bore diameter $D_1$ is enlarged slightly to $D_3$ by machining from one end of the liner part way into the annular liner portion 62. The bore diameter increases to $D_4$ for the remainder of annular liner portion 62. As can be seen in FIG. 6, $D_1<D_3<D_4$. The liner ring 70*a* is formed with an outside diameter that steps from $D_2$ to $D_3$ and is installed in the annular liner portion 62 as shown in FIG. 6. This construction requires pistons with unequal diameters, and also requires that the liner ring 70*a* have a stepped interior diameter such that in a first portion, the interior diameter is equal to or slightly greater than the diameter of the top land of the first piston and, in a second portion, the interior diameter is equal to or slightly greater than the diameter of the top land of the second piston. One or more air resistors may be formed between the outer surface sections of the liner ring 70*a* and the respective opposing sections of the bore 22.

Figure 7:
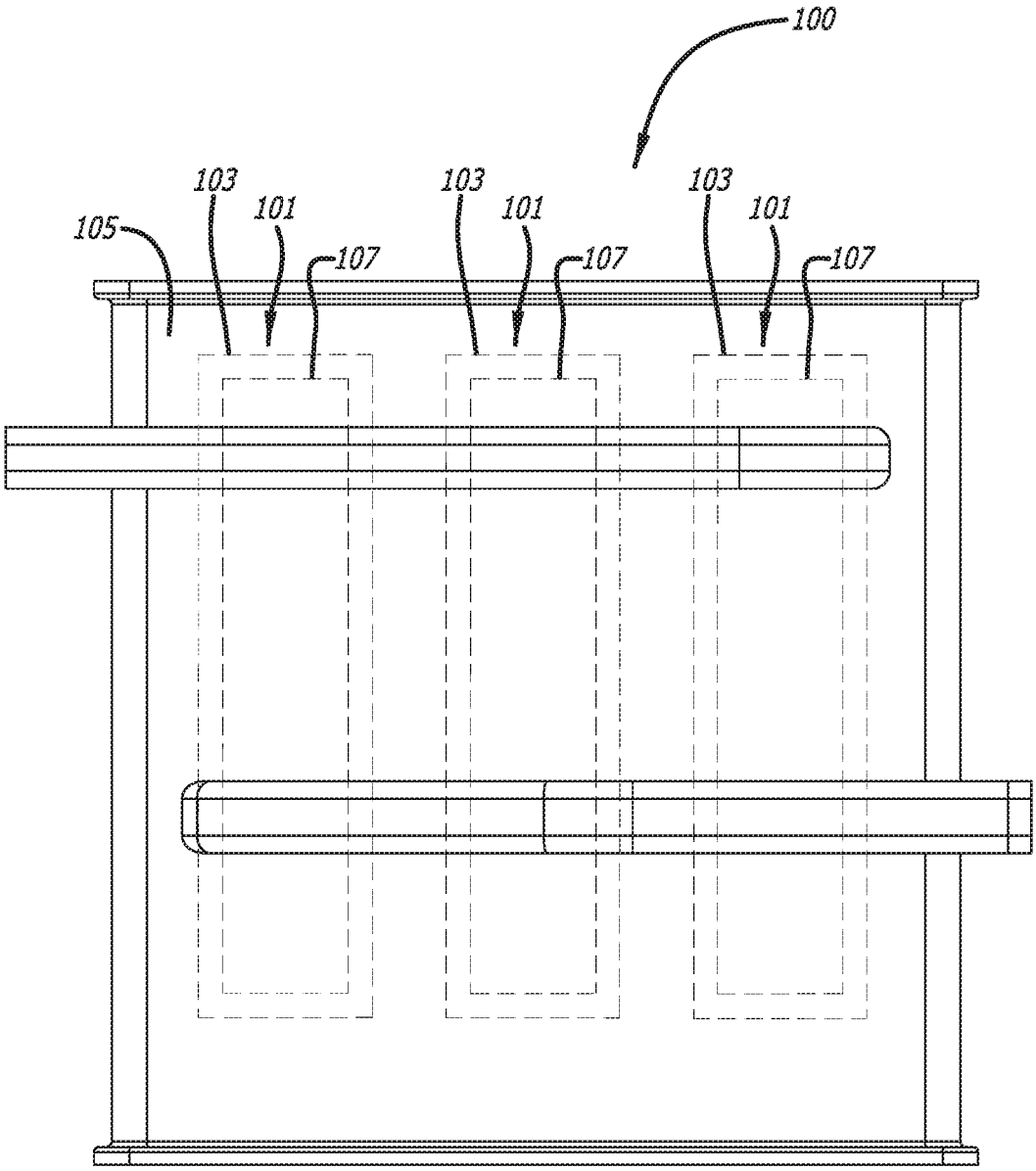
FIG. 7 is a schematic drawing of an opposed-piston engine 100 with one or more cylinder liners according to this specification.

FIG. 7 illustrates an opposed-piston engine 100 with three cylinders 101, in which each cylinder comprises a cylinder tunnel 103 in a cylinder block 105 and a cylinder liner 107 according to this specification seated in the cylinder tunnel. Of course, the number of cylinders is not meant to be limiting. In fact, the engine 100 may have fewer, or more, than three cylinders.

The scope of patent protection afforded these and other cylinder liner embodiments that accomplish one or more of the objectives of durability and thermal resistance of an opposed-piston engine according to this disclosure are limited only by the scope of any ultimately-allowed patent claims.

The invention claimed is:

1. A method of manufacturing a cylinder liner for an opposed-piston engine, comprising:
- providing a cylinder liner for an opposed-piston engine, in which the cylinder liner includes intake and exhaust ports near respective ends thereof;
- honing a bore of the cylinder liner having a first diameter D1 in the liner;
- forming an annular groove in the bore at an annular liner portion containing piston top center (TC) locations;
- providing an annular ring having an interior diameter D2, wherein D1>D2;
- heating the cylinder liner to increase the diameter D1;
- placing the annular ring in the bore over the annular groove;
- swaging the annular ring into the annular groove; and,
- cooling the cylinder liner and the annular ring.

2. The method of claim 1, further including completing the swaging by driving punches with a shape of a piston top land, from the ends of the cylinder liner to the annular ring, after cooling the cylinder liner and the annular ring.

3. The method of claim 2, further including forming one or more fuel injector ports through the annular liner portion and the annular ring.

4. The method of claim 3, further including honing the bore after forming the annular groove.

5. The method of claim 4, in which swaging the annular ring into the annular groove includes driving tapered mandrels through the center of the annular ring so as to expand the liner ring into the annular groove.

6. The method of claim 1, further comprising heating the annular ring.

7. The method of claim 1, in which the annular ring comprises one or more grooves on its outer annular surface which forms one or more annular air-filled chambers with the bore.

8. The method of claim 1, wherein the annular ring is formed of a ceramic material.

* * * * *